US011519409B2

(12) United States Patent
Vaidya

(10) Patent No.: US 11,519,409 B2
(45) Date of Patent: Dec. 6, 2022

(54) SCREW COMPRESSOR WITH EXTERNAL MOTOR ROTOR

(71) Applicant: Carrier Corporation, Palm Beach Gardens, FL (US)

(72) Inventor: Amit Vaidya, Jamesville, NY (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 21 days.

(21) Appl. No.: 17/048,019

(22) PCT Filed: Apr. 25, 2019

(86) PCT No.: PCT/US2019/029108
§ 371 (c)(1),
(2) Date: Oct. 15, 2020

(87) PCT Pub. No.: WO2019/210053
PCT Pub. Date: Oct. 31, 2019

(65) Prior Publication Data

US 2021/0172439 A1 Jun. 10, 2021

Related U.S. Application Data

(60) Provisional application No. 62/663,600, filed on Apr. 27, 2018.

(51) Int. Cl.
*F04C 18/16* (2006.01)
*F04C 29/02* (2006.01)

(52) U.S. Cl.
CPC ..... *F04C 18/16* (2013.01); *F04C 29/02* (2013.01); *F04C 2240/20* (2013.01);
(Continued)

(58) Field of Classification Search
CPC ..... F04C 18/16; F04C 29/02; F04C 29/0042; F04C 2240/20; F04C 2240/30; F04C 2240/40; F04C 2240/50; F04C 2270/07
See application file for complete search history.

(56) References Cited

U.S. PATENT DOCUMENTS 3,184,155 A * 5/1965 Crooks ..... F04C 23/001 418/9
4,983,106 A * 1/1991 Wright ..... F16H 57/0421 418/94

(Continued)

FOREIGN PATENT DOCUMENTS

CN 201332313 Y 10/2009
CN 104204530 A 12/2014

(Continued)

OTHER PUBLICATIONS

International Search Report of the International Searching Authority; International Application No. PCT/US2019/029108; International Filing Date: Apr. 25, 2019; dated Jul. 23, 2019; 5 pages.

(Continued)

*Primary Examiner* — Audrey B. Walter
*Assistant Examiner* — Dapinder Singh
(74) *Attorney, Agent, or Firm* — Cantor Colburn LLP

(57) ABSTRACT

A screw compressor includes a housing, a first rotor rotatable about a first axis relative to the housing, and a second rotor rotatable about a second axis relative to the housing. The second rotor is enmeshed with the first rotor. A motor is embedded within the first rotor such that the motor is coaxial with the first axis.

15 Claims, 2 Drawing Sheets

(52) U.S. Cl.
CPC ..... *F04C 2240/30* (2013.01); *F04C 2240/40* (2013.01); *F04C 2240/50* (2013.01)

(56) References Cited

U.S. PATENT DOCUMENTS

| | | | | |
|---|---|---|---|---|
| 5,002,470 | A | 3/1991 | Gormley et al. | |
| 5,123,818 | A | 6/1992 | Gormley et al. | |
| 6,241,490 | B1 | 6/2001 | Rippl | |
| 6,247,906 | B1 | 6/2001 | Pijanowski | |
| 6,652,249 | B2 | 11/2003 | Kenney et al. | |
| 7,413,419 | B2 | 8/2008 | De Smedt et al. | |
| 8,039,751 | B2 | 10/2011 | Tsuboi | |
| 8,162,622 | B2 | 4/2012 | Shoulders | |
| 10,738,781 | B2 * | 8/2020 | Johnson | F25B 49/022 |
| 2013/0058823 | A1 | 3/2013 | Ohmi et al. | |
| 2015/0292504 | A1 * | 10/2015 | Wang | F04C 27/00 417/410.3 |

FOREIGN PATENT DOCUMENTS

| | | | |
|---|---|---|---|
| CN | 104702073 | A | 6/2015 |
| CN | 105201839 | A | 12/2015 |
| CN | 105275811 | A | 1/2016 |
| CN | 105971876 | A | 9/2016 |
| CN | 105221387 | B | 12/2017 |
| CN | 107701443 | A | 2/2018 |
| GB | 1566687 | A | 5/1980 |
| JP | H01267384 | A | 10/1989 |
| WO | 2015083195 | A1 | 6/2015 |

OTHER PUBLICATIONS

Written Opinion of the International Searching Authority; International Application No. PCT/US2019/029108; International Filing Date: Apr. 25, 2019; dated Jul. 23, 2019; 8 pages.
Chinese First Office Action; Chinese Application No. 201980028701.7; dated Apr. 2, 2022; 16 pages.
Chinese Office Action; Chinese Application No. 201980028701.7; dated Sep. 8, 2022; 8 pages; No English Translation Available.

* cited by examiner

SCREW COMPRESSOR WITH EXTERNAL MOTOR ROTOR

CROSS REFERENCE TO RELATED APPLICATIONS

This application is a National Stage application of PCT/US2019/029108 filed Apr. 25, 2019, which claims priority to U.S. Provisional application 62/663,600 filed Apr. 27, 2018, both of which are incorporated by reference in their entirety herein.

BACKGROUND

Embodiments of the disclosure relate to compressors, and more particularly, to a motor for driving one or more screws about an axis of rotation in a screw-type compressor.

Screw type compressors are commonly used in air conditioning and refrigeration applications. In such a compressor, intermeshed male and female lobed rotors or screws are rotated about their respective axes to pump a working fluid from a low pressure inlet end to a high pressure outlet end. During rotation, sequential lobes of the male rotor serve as pistons driving refrigerant downstream and compressing it within the space between an adjacent pair of female rotor lobes and the housing. Likewise sequential lobes of the female rotor produce compression of refrigerant within a space between an adjacent pair of male rotor lobes and the housing. The interlobe spaces of the male and female rotors in which compression occurs form compression pockets.

An electric motor may be used to drive rotation of the rotors or screws about the respective axes. In some implementations, the electric rotor is arranged coaxial with and offset from the male rotor, along the length of the male rotor. Such positioning of the motor results in an increased axial length of the compressor. In other implementations, the motor may be mounted via a cantilevered arrangement, which may affect the operational speed of the compressor.

BRIEF DESCRIPTION

According to an embodiment, a screw compressor includes a housing, a first rotor rotatable about a first axis relative to the housing, and a second rotor rotatable about a second axis relative to the housing. The second rotor is enmeshed with the first rotor. A motor is embedded within the first rotor such that the motor is coaxial with the first axis.

In addition to one or more of the features described above, or as an alternative, in further embodiments the motor is an external rotor motor.

In addition to one or more of the features described above, or as an alternative, in further embodiments the first rotor further comprises a first hollow cavity, at least a portion of the motor being positioned within the first hollow cavity.

In addition to one or more of the features described above, or as an alternative, in further embodiments the first hollow cavity is arranged adjacent a first end of the first rotor.

In addition to one or more of the features described above, or as an alternative, in further embodiments the motor further comprises a motor stator and a motor rotor, the motor stator including at least one electromagnetic coil spaced about an outer periphery of the motor stator, and the motor rotor including at least one magnet spaced about an inner periphery of the motor rotor.

In addition to one or more of the features described above, or as an alternative, in further embodiments the motor stator is fixedly positioned within the first hollow cavity.

In addition to one or more of the features described above, or as an alternative, in further embodiments the motor rotor is formed as part of a body of the first rotor.

In addition to one or more of the features described above, or as an alternative, in further embodiments the at least one magnet and the at least one electromagnetic coil are axially aligned.

In addition to one or more of the features described above, or as an alternative, in further embodiments comprising a first shaft for rotatably mounting the first rotor, the first shaft being rotatable about the first axis with the first rotor.

In addition to one or more of the features described above, or as an alternative, in further embodiments the first shaft is integrally formed with the first rotor.

In addition to one or more of the features described above, or as an alternative, in further embodiments the first shaft is coupled to the first rotor.

In addition to one or more of the features described above, or as an alternative, in further embodiments the first shaft extends through an opening formed in the motor stator and is connected to the motor stator via at least one bearing.

In addition to one or more of the features described above, or as an alternative, in further embodiments the second rotor further comprises a second hollow cavity.

In addition to one or more of the features described above, or as an alternative, in further embodiments comprising a second shaft for rotatably mounting the second rotor, wherein the second shaft extends through the second hollow cavity.

In addition to one or more of the features described above, or as an alternative, in further embodiments the second shaft is stationary.

In addition to one or more of the features described above, or as an alternative, in further embodiments the second rotor is coupled to the second shaft via at least one bearing.

In addition to one or more of the features described above, or as an alternative, in further embodiments the first rotor is a male rotor and the second rotor is a female rotor.

In addition to one or more of the features described above, or as an alternative, in further embodiments the first rotor is a female rotor and the second rotor is a male rotor.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

The term "about" is intended to include the degree of error associated with measurement of the particular quantity based upon the equipment available at the time of filing the application.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

Figure 1:
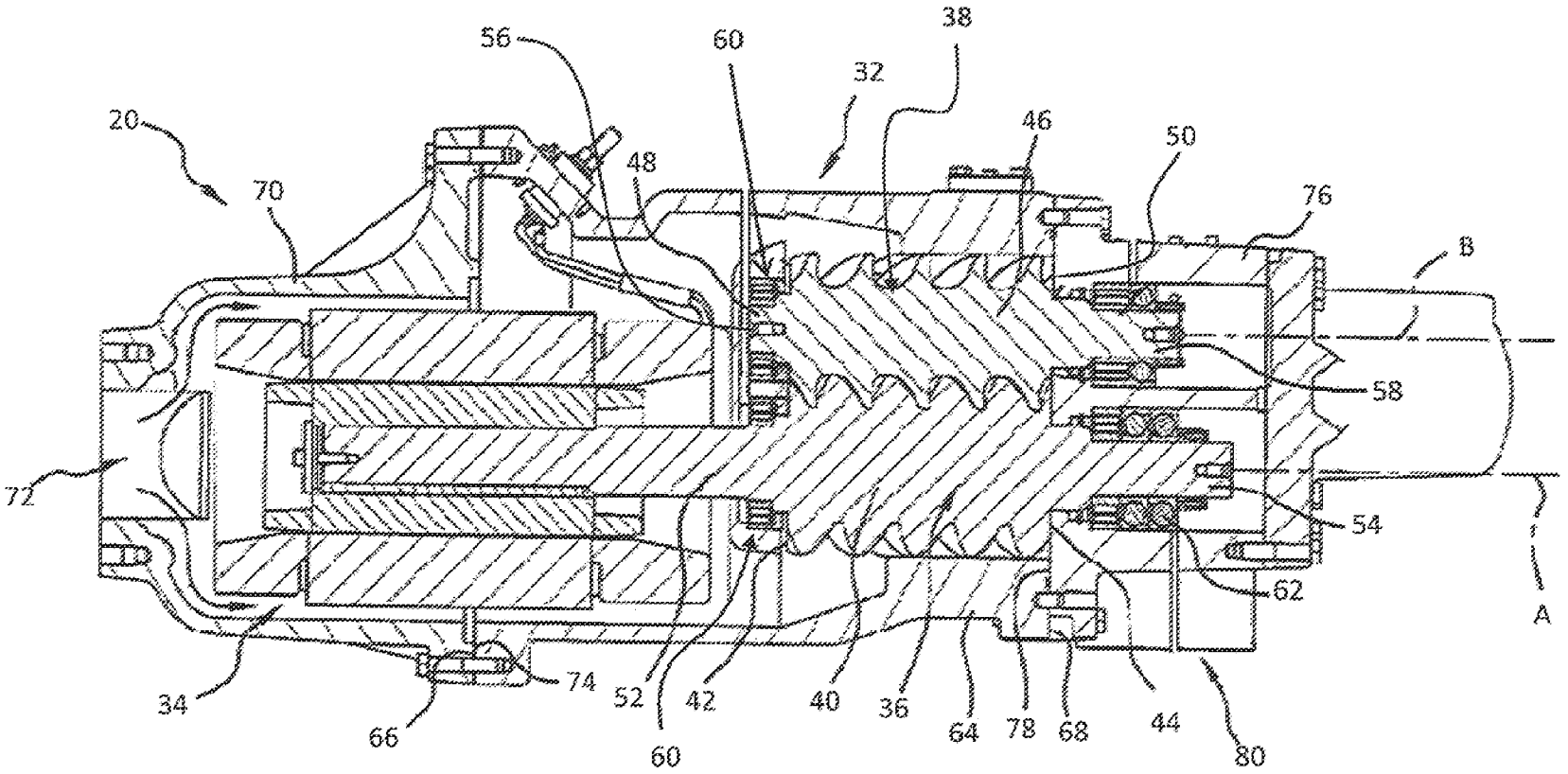
FIG. 1 is a simplified cross-sectional view of a screw compressor.

Referring now to FIG. 1, an example of an existing screw compressor 20, commonly used in heating, ventilation, air conditioning, and refrigeration systems, is illustrated in more detail. The screw compressor 20 includes a housing assembly 32 containing a motor 34 and two or more intermeshing screw rotors 36, 38 having respective central longitudinal axes A and B. In the illustrated embodiment, the rotor 36 has a male lobed body 40 extending between a first end 42 and a second end 44. The male lobed body 40 is enmeshed with a female lobed body 46 of the other rotor 38. The female lobed body 46 of the rotor 38 has a first end 48 and a second end 50. Each rotor 36, 38 includes shaft portions 52, 54, 56, 58 extending from the first and second ends 42, 44, 48, 50 of the associated working portion 40, 46. The shaft portions 52 and 56 are mounted to the housing 32 by one or more inlet bearings 60 and the shaft portions 54 and 58 are mounted to the housing 32 by one or more outlet bearings 62 for rotation about the associated rotor axis A, B.

In existing screw compressor, the motor 34 is coupled to an extended shaft portion 52 of the rotor 36 and is operable to drive that rotor 36 about its axis A. When so driven in an operative first direction, the rotor 36 drives the other rotor 38 in an opposite second direction. As shown, the housing assembly 32 includes a rotor housing 64 having an upstream/inlet end face 66 and a downstream/discharge end face 68 essentially coplanar with the rotor second ends 44 and 50. Although a particular configuration of a screw compressor is illustrated and described herein, other compressors, such as having three screw rotors for example, are also within the scope of the invention.

The housing assembly 32 further comprises a motor/inlet housing 70 having a compressor inlet/suction port 72 at an upstream end and having a downstream face 74 mounted to the rotor housing upstream face 66 (e.g., by bolts through both housing pieces). The assembly 32 further includes an outlet/discharge housing 76 having an upstream face 78 mounted to the rotor housing downstream face 68 and having an outlet/discharge port 80. The exemplary rotor housing 64, the motor/inlet housing 70, and outlet housing 76 may each be formed as castings subject to further finish machining. The refrigerant vapor enters into the inlet or suction port 72 with a suction pressure $P_S$ and exits the discharge port 80 of the compressor 20 with a discharge pressure $P_D$. The refrigerant vapor within the compression mechanism of the two or more rotors 36, 38, between the inlet port 72 and the discharge port 80 has an intermediate pressure $P_I$.

Figure 2:
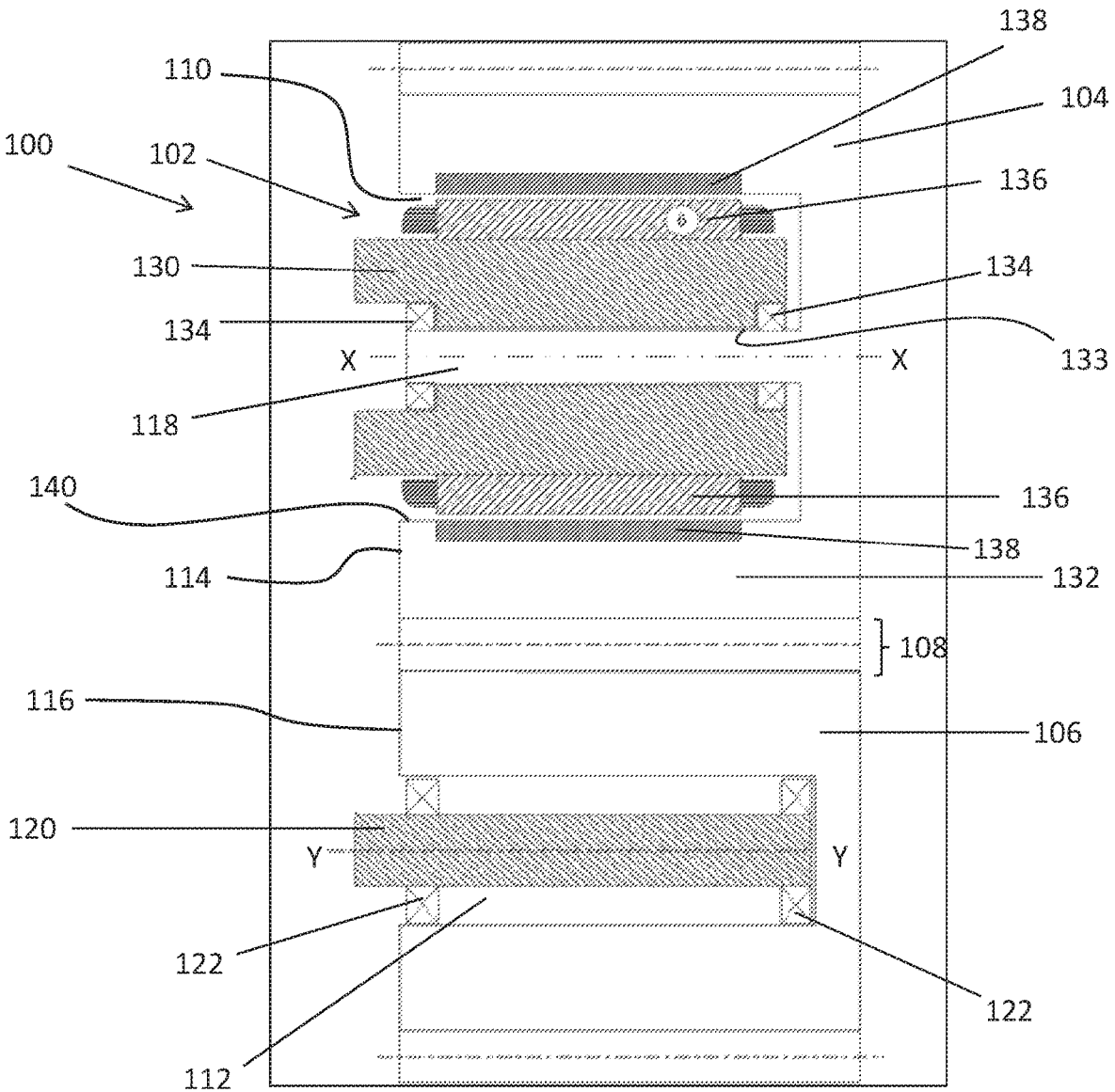
FIG. 2 is a cross-sectional view of a portion of a screw compressor according to an embodiment.

With reference now to FIG. 2, a cross-sectional view of a portion of a screw compressor 100 according to an embodiment is illustrated. Although the screw compressor 100 of FIG. 2 is similar to an existing screw compressor, the screw compressor 100 has a reduced axial length compared to the screw compressor 20 of FIG. 1. As will be described in more detail, the motor 102 of the screw compressor 100 is integrated into one of the screw rotors of the compressor 100.

Similar to existing screw compressors, in the illustrated, non-limiting embodiment, the screw compressor 100 includes at least a first screw rotor 104 and a second screw rotor 106. As shown, the first screw rotor 104 is a male screw rotor and the second screw rotor 106 is a female screw rotor; however, in other embodiments, the first screw rotor 104 may be female and the second screw rotor 106 may be male. The first and second screw rotors 104, 106 are arranged in intermeshing engagement at a region in the FIG. identified as 108.

A first hollow internal cavity 110 is formed in the first screw rotor 104, and a second hollow internal cavity 112 is formed in the second screw rotor 106. The cavities 110, 112, may extend over all or a portion of the length of each screw rotor 104, 106. In the illustrated, non-limiting embodiment, the first cavity 110 is formed at a first end 114 of the first screw rotor 104 and has a length corresponding to a length of the motor 102. The second cavity 112 formed in the second rotor 106 may also be arranged adjacent the first end 116 of the second rotor 106 and have a length generally equal to the first cavity 110 such that the first cavity 110 and the second cavity 112 are generally aligned. However, embodiments where the configuration of the second cavity 112 is different from the configuration of the first cavity 110 are also within the scope of the disclosure.

The first screw rotor 104 and the second screw rotor 106 are rotatably supported by a first and second shaft 118, 120, respectively. In an embodiment, the first shaft extends through the first cavity 110 and is configured to rotate about an axis X with the first screw rotor 104. Although the first shaft 118 is illustrated as being integrally formed with a portion of the first screw rotor 104, embodiments where the first shaft 118 is a separate component coupled to the first screw rotor 104 are also within the scope of the disclosure. The second shaft 120 may similarly extend through the second cavity 112. In the illustrated, non-limiting embodiment, the second shaft 120 is stationary and the second screw rotor 106 is configured to rotate about an axis Y relative to the shaft 120 via one or more bearings 122 disposed between the shaft 120 and the screw rotor 106. However, in other embodiments, the second shaft 120 may be coupled to and configured to rotate with the second screw rotor 106.

A motor 102 is operable to drive the plurality of screw rotors 104, 106 about their respective axes X, Y. As shown, the motor 102 is embedded within a cavity 110, 112 of one of the plurality of screw rotors 104, 106. In the illustrated, non-limiting embodiment, the motor 102 is embedded within the first cavity 110 of the first screw rotor 104; however embodiments where the motor 102 is embedded within the second cavity 112 of the second screw rotor 106 or a cavity formed in another screw rotor are also contemplated herein.

The electric motor 102 includes a motor stator 130 fixedly coupled to a housing (not shown) of the screw compressor 100, and a motor rotor 132 configured to rotate about one of the screw axes. In an embodiment, the motor stator 130 is located at a position within the first cavity 110. The stationary motor stator 130 includes an opening 133, through which the first shaft 118 extends. The motor stator 130 is coupled to the first shaft 118 via one or more bearings 134. As a result, the first shaft 118 and first screw rotor 104 are configured to rotate about their axis X, relative to the motor stator 130. In an embodiment, the stator 130 includes at least one electromagnetic coil 136. The electromagnetic coils 136 may be spaced circumferentially about the outer periphery of the stator 130. The total number of electromagnetic coils 136 included in the motor stator 130 may vary based on the desired performance of the motor 102. In addition, by forming the first cavity 110 adjacent the first end 114 of the first screw rotor 104, one or more wires (not shown) may be readily connected to the electromagnetic coils 136.

The first screw rotor 104 forms the motor rotor 132. Accordingly, the motor rotor 132 is arranged concentrically with and radially outward from the motor stator 130. The motor rotor 132 may include one or more permanent magnets 138. In the illustrated, non-limiting embodiment, the one or more permanent magnets 138 are positioned at an interior surface 140 of the first screw rotor 104, facing the first cavity 110. The magnets 138 may be arranged generally circumferentially about the surface 140 of the first screw rotor 104. As shown, the magnets 138 are positioned in general alignment with the electromagnetic coils 136 of the motor stator 130. The motor rotor 132 is configured to rotate about axis X with respect to the stator 130 as the magnets 138 of the rotor 132 react with an induced magnetic field generated when the electromagnetic coils 136 of the motor stator 130 are energized. Although the motor rotor 132 is illustrated and described herein as a permanent magnet rotor, other types of rotors, such as an induction motor rotor for example, is also within the scope of the disclosure.

By embedding the motor 102 within one of the plurality of screw rotors of a compressor, the overhang arrangement required for current screw compressors may be eliminated. As a result, an overall length of the screw compressor will be reduced, allowing for more compact designs. Further, by eliminating the cantilevered motor arrangement, the speed of the compressor is improved, enhancing the overall operation of the compressor. The positioning of the motor 102 within a rotor will also facilitate isolation of the bearing lubrication from the refrigerant.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A screw compressor comprising:
a housing;
a first rotor mounted within the housing via a first shaft, the first rotor and the first shaft being rotatable about a first axis relative to the housing, wherein the first rotor further comprises a first hollow cavity;
a second rotor rotatable about a second axis relative to the housing, the second rotor being enmeshed with the first rotor; and
a motor embedded within the first hollow cavity such that the motor is coaxial with the first axis, the motor further comprising a motor stator and a motor rotor, the motor stator being coupled to the first shaft via at least one bearing and the motor rotor being arranged concentrically with the motor stator, the motor rotor being arranged radially outward from the motor stator.

2. The screw compressor of claim 1, wherein the first hollow cavity is arranged adjacent a first end of the first rotor.

3. The screw compressor of claim 1, wherein the motor stator includes at least one electromagnetic coil spaced about an outer periphery of the motor stator, and the motor rotor includes at least one magnet spaced about an inner periphery of the motor rotor.

4. The screw compressor of claim 3, wherein the motor stator is fixedly positioned within the first hollow cavity.

5. The screw compressor of claim 3, wherein the motor rotor is formed as part of a body of the first rotor.

6. The screw compressor of claim 3, wherein the at least one magnet and the at least one electromagnetic coil are axially aligned.

7. The screw compressor of claim 3, wherein the second rotor further comprises a second hollow cavity.

8. The screw compressor of claim 7, further comprising a second shaft for rotatably mounting the second rotor, wherein the second shaft extends through the second hollow cavity.

9. The screw compressor of claim 8, wherein the second shaft is stationary.

10. The screw compressor of claim 8, wherein the second rotor is coupled to the second shaft via at least one bearing.

11. The screw compressor of claim 1, wherein the first shaft is integrally formed with the first rotor.

12. The screw compressor of claim 1, wherein the first shaft is coupled to the first rotor.

13. The screw compressor of claim 1, wherein the first shaft extends through an opening formed in the motor stator and is connected to the motor stator via at least one bearing.

14. The screw compressor of claim 1, wherein the first rotor is a male rotor and the second rotor is a female rotor.

15. The screw compressor of claim 1, wherein the first rotor is a female rotor and the second rotor is a male rotor.

* * * * *